US006929292B1

(12) United States Patent
Galindo et al.

(10) Patent No.: US 6,929,292 B1
(45) Date of Patent: Aug. 16, 2005

(54) LEVER LOCK SYSTEM

(76) Inventors: Mauricio Galindo, 7630 Dunbridge Dr., Odessa, FL (US) 33556-2258; Jaime Galindo, 445 Laughing Gull La., Palm Harbor, FL (US) 34683

( * ) Notice: Subject to any disclaimer, the term of this patent is extended or adjusted under 35 U.S.C. 154(b) by 0 days.

(21) Appl. No.: 10/754,183

(22) Filed: Jan. 9, 2004

(51) Int. Cl.[7] ..... E05C 19/18
(52) U.S. Cl. ..... 292/288; 292/DIG. 2; 292/1; 70/416
(58) Field of Search ..... 292/288, DIG. 2, 292/1, DIG. 37; 70/416

(56) References Cited

U.S. PATENT DOCUMENTS 4,095,445 A * 6/1978 Storlie et al. ..... 70/215
4,947,663 A * 8/1990 Yeager ..... 70/416
5,865,050 A * 2/1999 Michaud et al. ..... 70/416
5,901,590 A * 5/1999 Lai ..... 70/416

* cited by examiner

*Primary Examiner*—Gary Estremsky
(74) *Attorney, Agent, or Firm*—Edward P. Dutkiewicz

(57) ABSTRACT

A lever lock system has a lever handle with a shaft and arm and a securing mechanism. The shaft passes through an aperture in a mounting plate coupled to a door. A support member has a closed rear face, an open front face and an internal region with a hollow cylinder with a hollow center extending to a central bore in the closed rear face of the support member. The central bore has a retaining lip adjacent to the open front face. The rear face is adapted to couple with the mounting plate. A push button has an open back face, closed front plate and a hollow shaft adapted to telescope over the support member with the hollow shaft adapted to telescope over the hollow cylinder. A screw couples the support member within the push button. A spring is retained over the hollow shaft of the push button.

4 Claims, 4 Drawing Sheets

FIG 3
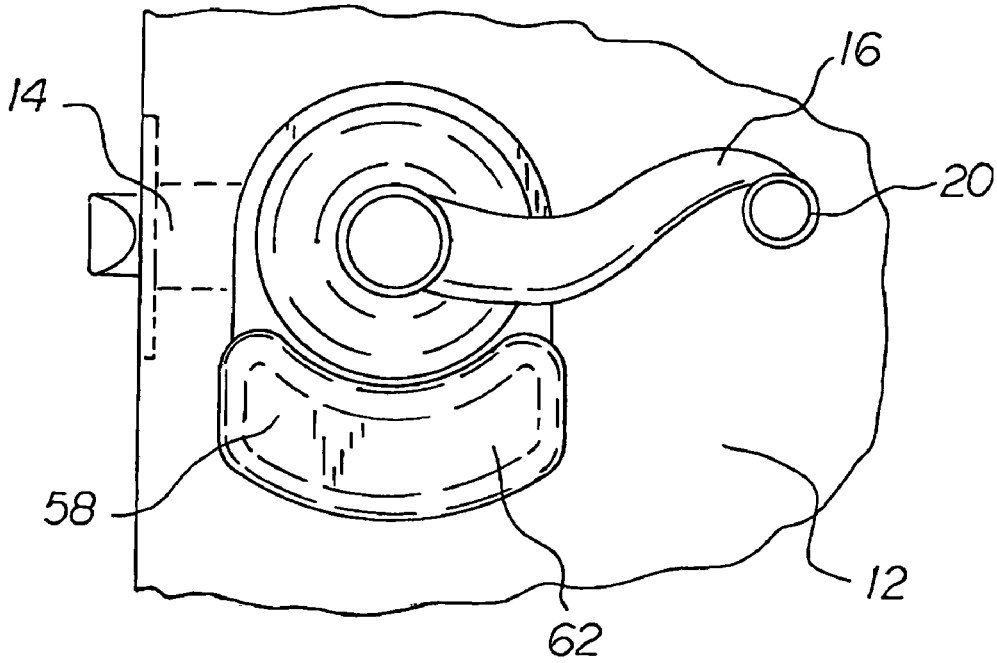
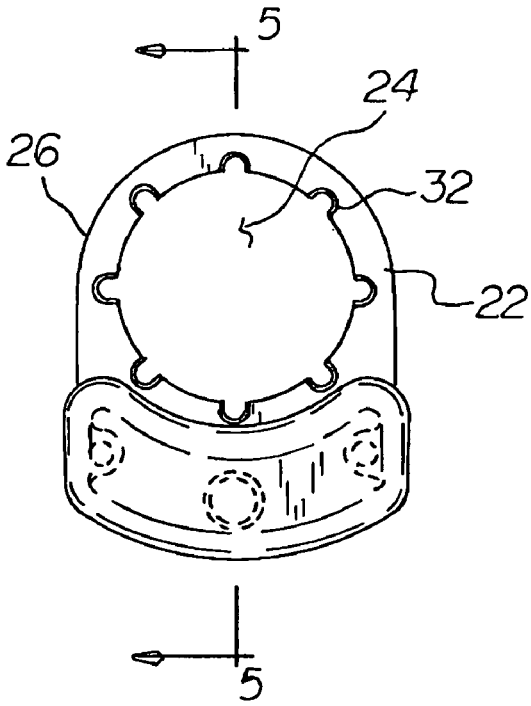
FIG 4

FIG 5
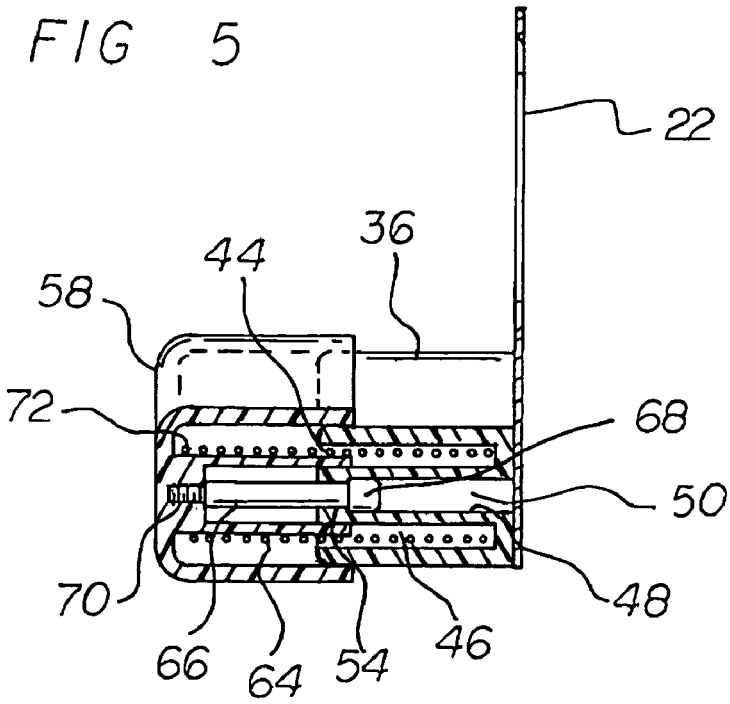
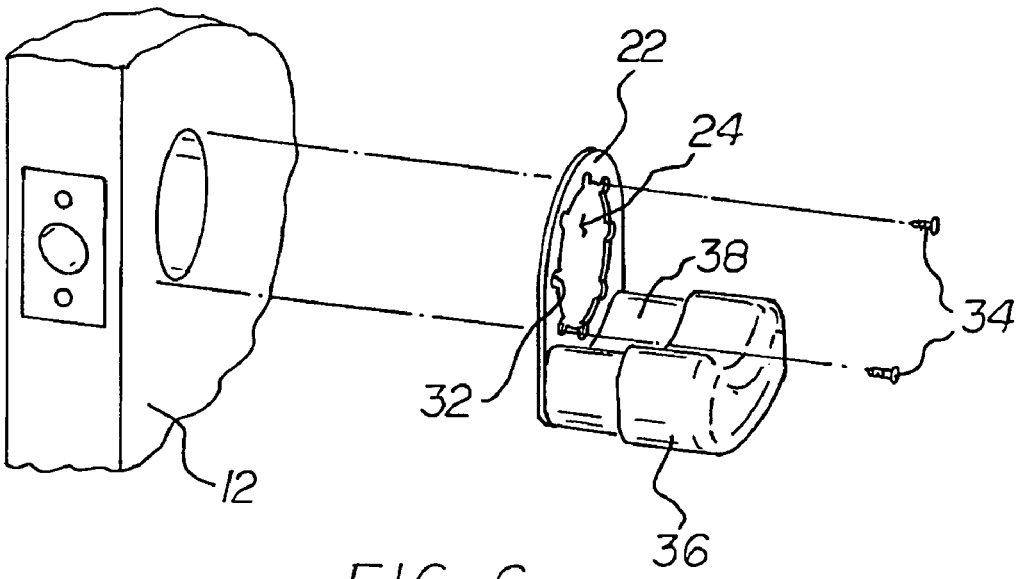
FIG 6

LEVER LOCK SYSTEM

BACKGROUND OF THE INVENTION

1. Field of the Invention

The present invention relates to a lever lock system and more particularly pertains to precluding a child from opening a door without the child performing a complex compound movement.

2. Description of the Prior Art

The use of childproof locking systems of known designs and configurations is known in the prior art. More specifically, childproof locking systems of known designs and configurations previously devised and utilized for the purpose of preventing children from opening doors are known to consist basically of familiar, expected, and obvious structural configurations, notwithstanding the myriad of designs encompassed by the crowded prior art which has been developed for the fulfillment of countless objectives and requirements.

By way of example, United States Patent Number U.S. Pat. No. 6,526,786 to Kayoda issued Mar. 4, 2003 and relates to a protective lock box cover. U.S. Pat. No. 6,499,254 to Rossman et al issued Dec. 31, 2002 and relates to gate unlocking. U.S. Pat. No. 5,626,372 to Vogt issued May 6, 1997 and relates to engageable and disengageable safety latch. Lastly, U.S. Pat. No. 4,253,690 to Hollander issued Mar. 3, 1981 and relates to a safety knob.

While these devices fulfill their respective, particular objectives and requirements, the aforementioned patents do not describe a lever lock system that allows precluding a child from opening a door without the child performing a complex compound movement.

In this respect, the lever lock system according to the present invention substantially departs from the conventional concepts and designs of the prior art, and in doing so provides an apparatus primarily developed for the purpose of precluding a child from opening a door without the child performing a complex compound movement.

Therefore, it can be appreciated that there exists a continuing need for a new and improved lever lock system which can be used for precluding a child from opening a door without the child performing a complex compound movement. In this regard, the present invention substantially fulfills this need.

SUMMARY OF THE INVENTION

In view of the foregoing disadvantages inherent in the known types of childproof locking systems of known designs and configurations now present in the prior art, the present invention provides an improved lever lock system. As such, the general purpose of the present invention, which will be described subsequently in greater detail, is to provide a new and improved lever lock system and method which has all the advantages of the prior art and none of the disadvantages.

To attain this, the present invention essentially comprises a door with a securing mechanism. The securing mechanism includes a lever handle with a central pivotable shaft and perpendicularly extending arm. The arm is adapted to oscillate between a generally horizontal locking orientation, as shown in FIGS. 1 and 3, and a generally vertical unlocking orientation, as shown in FIG. 2, to allow a user to release the securing mechanism and open the door.

Next, a mounting plate is provided. The mounting plate is in a generally planar configuration having an upper extent with generally circular aperture and a spaced lower extent with a pair of bores. The circular aperture has a plurality of notches equally spaced around the extent thereof and is adapted to receive a plurality of retaining screws to couple the mounting plate to the door. In this manner, the pivotable shaft of the securing mechanism passes through the circular aperture of the mounting plate.

A support member is next provided. The support member is in a generally rectilinear configuration. The support member has a semicircular recess portion and a top face adapted to avoid interfering with the movement of the securing mechanism. The support member has a closed rear face, an open front face. An internal region of the support member has a hollow cylinder of a first diameter. A hollow center of the cylinder extends to a central bore in the closed rear face of the support member. The central bore has a retaining lip adjacent to the open front face. The rear face also has a pair of spaced apertures adapted to align with the bore on the lower extent of the mounting plate to couple the support member with the mounting plate using a pair of coupling screws.

Next provided is a push button. The push button is of a generally rectilinear configuration with dimensions greater that the support member. The push button has an open back face, a closed front plate and a hollow shaft of a second diameter greater than the first diameter. The push button is adapted to telescope over the support member. The hollow shaft of the push button is adapted to telescope over the hollow cylinder of the support member.

A shoulder screw is next provided. The shoulder screw has a solid generally cylindrical configuration with an obtuse first end and a threaded recessed second end. The shoulder screw is adapted to house within the hollow cylinder of the support member. The obtuse first end is adapted to rest against the retaining lip and the threaded recess is adapted to screwably couple to the closed front plate of the push button within the hollow shaft. In this manner the support member is retained within the confines of the push button.

Next, a spring is provided. The spring is of a third diameter greater than the second diameter. The spring is adapted to be retained over the hollow shaft of the push button to thereby keep compressable tension between the push button and the support member. In this manner, when the system is at rest the spring keeps the push button extended and prevents the rotation of the secure mechanism shaft by preventing the rotation of the lever handle thereby preventing the opening of the door. When the system is activated by a user through a first motion of compressing the push button against the force of the spring, and through a second motion of rotating of the lever handle from the horizontal orientation to the vertical orientation, the user, in a complex and compound motion, is able to allow the door to be opened.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lever lock system which has all of the advantages of the prior art childproof locking systems of known designs and configurations and none of the disadvantages.

It is another object of the present invention to provide a new and improved lever lock system which may be easily and efficiently manufactured and marketed.

It is further object of the present invention to provide a new and improved lever lock system which is of durable and reliable constructions.

An even further object of the present invention is to provide a new and improved lever lock system which is susceptible of a low cost of manufacture with regard to both materials and labor, and which accordingly is then susceptible of low prices of sale to the consuming public, thereby making such lever lock system economically available to the buying public.

Even still another object of the present invention is to provide a lever lock system for precluding a child from opening a door without the child performing a complex compound movement.

Lastly, it is an object of the present invention to provide a new and improved lever lock system having a lever handle with a shaft and arm and a securing mechanism. A mounting plate with an aperture is adapted to couple to a door such that the shaft passes through the aperture. A support member has a closed rear face, an open front face and an internal region with a hollow cylinder with a hollow center extending to a central bore in the closed rear face of the support member. The central bore has a retaining lip adjacent to the open front face. The rear face is adapted to couple with the mounting plate. A push button has an open back face, closed front plate and a hollow shaft adapted to telescope over the support member with the hollow shaft adapted to telescope over the hollow cylinder. A screw couples the support member within the push button. A spring is adapted to be retained over the hollow shaft of the push button.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the present invention taken along line 3—3 of FIG. 1.

FIG. 4 is a plan view of the mounting plate, support member and push button of the present invention.

FIG. 5 is a cross sectional view of the present invention taken along line 5—5 of FIG. 4.

FIG. 6 is an exploded illustration of the present invention.

The same reference numerals refer to the same parts throughout the various Figures.

DESCRIPTION OF THE PREFERRED EMBODIMENT

Figure 1:
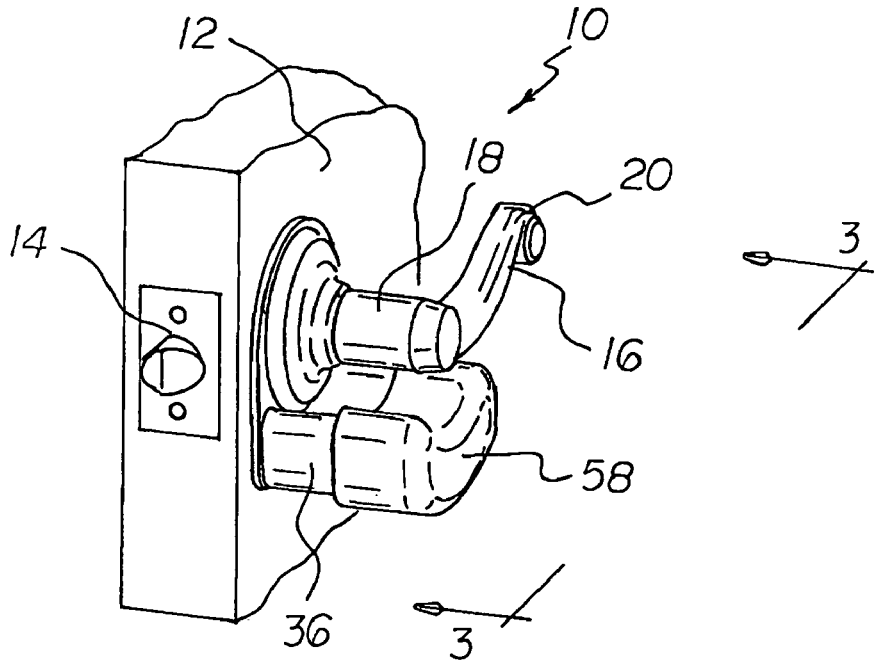
FIG. 1 is a perspective illustration of the present inventions with the arm in a locking position.

With reference now to the drawings, and in particular to FIG. 1 thereof, the preferred embodiment of the new and improved lever lock system embodying the principles and concepts of the present invention and generally designated by the reference numeral 10 will be described.

The present invention, the lever lock system 10 is comprised of a plurality of components. Such components in their broadest context include a lever handle, a mounting plate, a support member, a push button, a screw, and a spring. Such components are individually configured and correlated with respect to each other so as to attain the desired objective.

Figure 2:
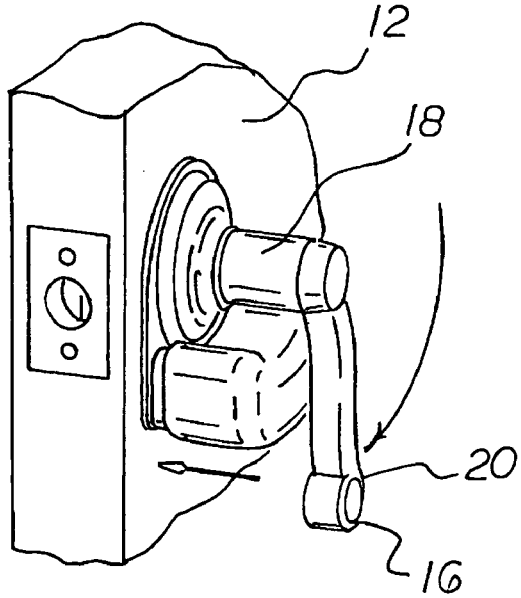
FIG. 2 is a perspective illustration of the present invention with the arm in an unlocking position.
Figure 7:
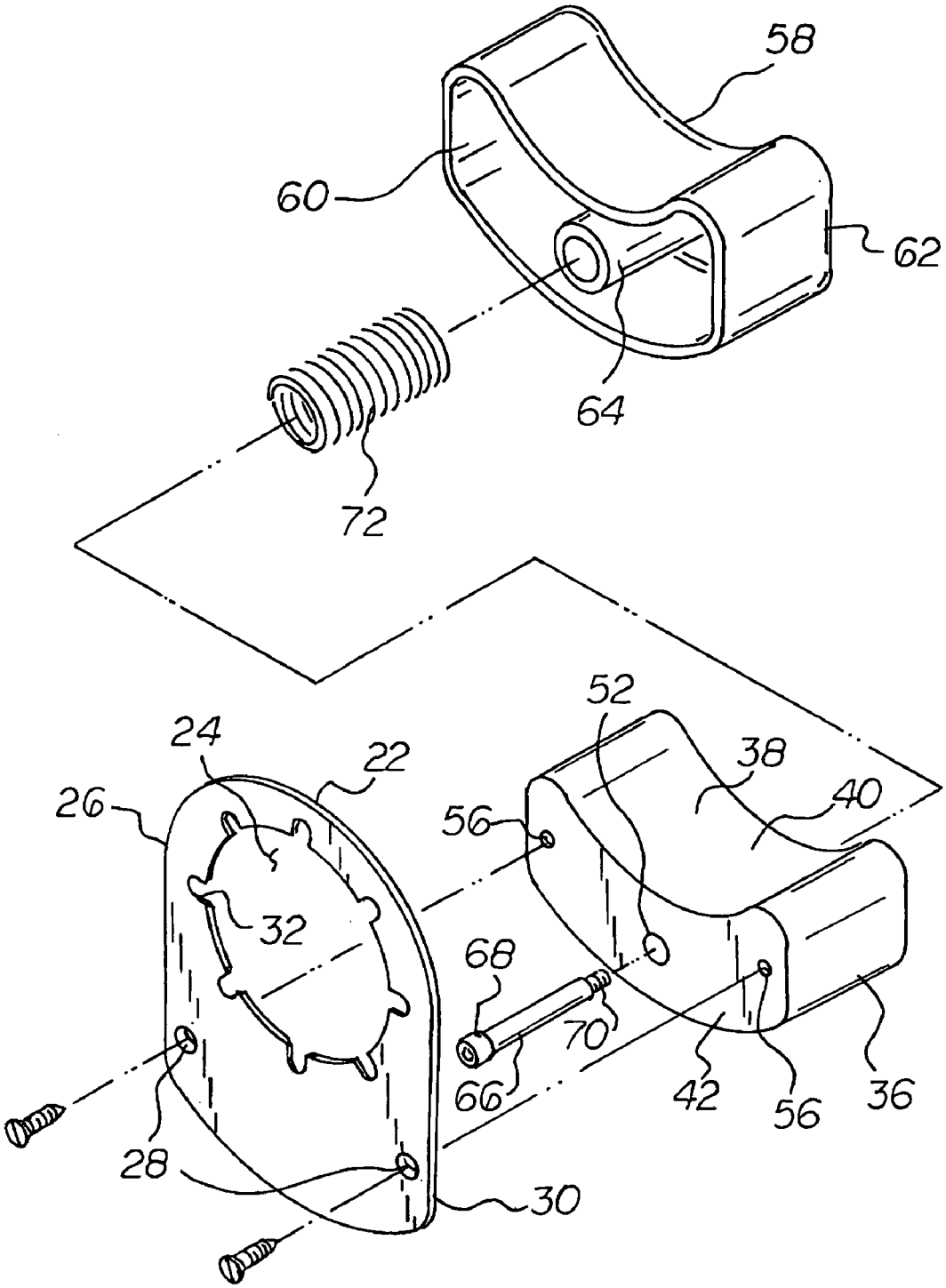
FIG. 7 is an exploded illustration of the present invention.

First provided is a door 12. The door has a securing mechanism 14. The securing mechanism includes a lever handle 16 with a central pivotable shaft 18 and perpendicularly extending arm 20. The arm is adapted to oscillate between a generally horizontal locking orientation, as shown in FIGS. 1 and 3, and a generally vertical unlocking orientation, as shown in FIG. 2, to allow a user to release the securing mechanism and open the door.

Next, a mounting plate 22 is provided. The mounting plate is in a generally planar configuration having an upper extent 26 with generally circular aperture 24 and a spaced lower extent 30 with a pair of bores 28. The circular aperture has a plurality of notches 32 equally spaced around the extent thereof and is adapted to receive a plurality of retaining screws 34 to couple the mounting plate to the door. In this manner, the pivotable shaft of the securing mechanism passes through the circular aperture of the mounting plate.

A support member 36 is next provided. The support member is in a generally rectilinear configuration. The support member has a semicircular recess portion 38 and a top face 40 adapted to avoid interfering with the movement of the securing mechanism. The support member has a closed rear face 42, an open front face 44. An internal region 46 of the support member has a hollow cylinder 48 of a first diameter. A hollow center 50 of the cylinder extends to a central bore 52 in the closed rear face of the support member. The central bore has a retaining lip 54 adjacent to the open front face. The rear face also has a pair of spaced apertures 56 adapted to align with the bore on the lower extent of the mounting plate to couple the support member with the mounting plate using a pair of coupling screws.

Next provided is a push button 58. The push button is of a generally rectilinear configuration with dimensions greater that the support member. The push button has an open back face 60, a closed front plate 62 and a hollow shaft 64 of a second diameter greater than the first diameter. The push button is adapted to telescope over the support member. The hollow shaft of the push button is adapted to telescope over the hollow cylinder of the support member.

A shoulder screw 66 is next provided. The shoulder screw has a solid generally cylindrical configuration with an obtuse first end 68 and a threaded recessed second end 70. The shoulder screw is adapted to house within the hollow cylinder of the support member. The obtuse first end is adapted to rest against the retaining lip and the threaded recess is adapted to screwably couple to the closed front plate of the push button within the hollow shaft. In this manner the support member is retained within the confines of the push button.

Next, a spring 72 is provided. The spring is of a third diameter greater than the second diameter. The spring is adapted to be retained over the hollow shaft of the push button to thereby keep compressable tension between the push button and the support member. In this manner, when the system is at rest the spring keeps the push button extended and prevents the rotation of the secure mechanism shaft by preventing the rotation of the lever handle thereby preventing the opening of the door. When the system is activated by a user through a first motion of compressing the push button against the force of the spring, and through a second motion of rotating of the lever handle from the horizontal orientation to the vertical orientation, the user, in a complex and compound motion, is able to allow the door to be opened.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lever lock system for precluding a child from opening a door without performing a complex compound movement comprising in combination:

a door with a securing mechanism including a lever handle with a central pivotable shaft and perpendicularly extending arm, the arm being adapted to oscillate between a generally horizontal locking orientation and a generally vertical unlocking orientation to allow a user to release the securing mechanism and open the door;

a mounting plate in a generally planar configuration having an upper extent with a generally circular aperture and a spaced lower extent with a pair of bores, the circular aperture having a plurality of notches equally spaced around the extent thereof and being adapted to receive a plurality of retaining screws to couple the mounting plate to the door such that the pivotable shaft of the securing mechanism passes through the circular aperture of the mounting plate;

a support member in a generally rectilinear configuration with a semicircular recess portion and a top face adapted to avoid interfering with the movement of the securing mechanism, a closed rear face, an open front face and an internal region of the support member having a hollow cylinder of a first diameter with a hollow center of the cylinder extending to a central bore in the closed rear face of the support member, the central bore having a retaining lip adjacent to the open front face, the rear face also having a pair of spaced apertures adapted to align with the bore on the lower extent of the mounting plate to couple the support member with the mounting plate with a pair of coupling screws;

a push button of a generally rectilinear configuration with dimensions greater than the support member and having an open back face, a closed front plate and a hollow shaft of second diameter greater than the first diameter, the push button being adapted to telescope over the support member with the hollow shaft of the push button being adapted to telescope over the hollow cylinder of the support member;

a shoulder screw having a solid generally cylindrical configuration with an obtuse first end and a threaded recessed second end, the shoulder screw being adapted to house within the hollow cylinder of the support member with the obtuse first end being adapted to rest against the retaining lip and the threaded recess being adapted to screwably couple to the closed front plate of the push button within the hollow shaft, thereby retaining the support member within the confines of the push button;

a spring of a third diameter greater than the second diameter and being adapted to be retained over the hollow shaft of the push button to thereby keep compressible force between the push button and the support member such that when the system is at rest the spring keeps the push button extended and prevents the rotation of the securing mechanism shaft by preventing the rotation of the lever handle thereby preventing the opening of the door, and when the system is activated by a user through a first motion of compressing the push button against the force of the spring, and through a second motion of rotating of the lever handle from the horizontal orientation to the vertical orientation, the user, in a complex and compound motion, is able to allow the door to be opened.

2. A lever lock system comprising:

a lever handle with a shaft and arm and a securing mechanism;

a mounting plate having an aperture adapted to couple to a door such that the shaft passes through the aperture;

a support member with a closed rear face, an open front face and an internal region having a hollow cylinder with a hollow center extending to a central bore in the closed rear face of the support member, the central bore having a retaining lip adjacent to the open front face, the rear face being adapted to couple with the mounting plate;

a push button having an open back face, closed front plate and a hollow shaft adapted to telescope over the support member with the hollow shaft adapted to telescope over the hollow cylinder;

a shoulder screw having a solid generally cylindrical configuration with an obtuse first end and a threaded recessed second end, the shoulder screw being adapted to house within the hollow cylinder of the support member with the obtuse first end being adapted to rest against the retaining lip and the threaded recess being adapted to screwably couple to the closed front plate of the push button within the hollow shaft, thereby retaining the support member within the confines of the push button; and a spring being adapted to be retained over the hollow shaft of the push button.

3. A lever lock system comprising:

a lever handle with a shaft and arm and a securing mechanism;

a support member with a closed rear face, an open front face and an internal region having a hollow cylinder with a hollow center extending to a central bore in the closed rear face of the support member, the central bore having a retaining lip adjacent to the open front face, the rear face being adapted to couple with the mounting plate;

a push button having an open back face, closed front plate and a hollow shaft adapted to telescope over the support member with the hollow shaft adapted to telescope over the hollow cylinder;

a screw to couple the support member within the push button;

a spring being adapted to be retained over the hollow shaft of the push button; and a mounting plate in a generally planar configuration having an upper extent with a generally circular aperture and a spaced lower extent with a pair of bores, the circular aperture having a plurality of notches equally spaced around the extent thereof and being adapted to receive a plurality of retaining screws to couple the mounting plate to the door such that the pivotable shaft of the securing mechanism passes through the circular aperture of the mounting plate.

4. A lever lock system comprising:

a lever handle with a shaft and arm and a securing mechanism;

a mounting plate having an aperture adapted to couple to a door such that the shaft passes through the aperture;

a support member with a closed rear face, an open front face and an internal region having a hollow cylinder with a hollow center extending to a central bore in the closed rear face of the support member, the central bore having a retaining lip adjacent to the open front face, the rear face being adapted to couple with the mounting plate;

a push button having an open back face, closed front plate and a hollow shaft adapted to telescope over the support member with the hollow shaft adapted to telescope over the hollow cylinder;

a screw to couple the support member within the push button; and a spring of a diameter adapted to be retained over the hollow shaft of the push button to thereby keep compressible tension between the push button and the support member such that when the system is at rest the spring keeps the push button extended and prevents the rotation of the secure mechanism shaft by preventing the rotation of the lever handle thereby preventing the opening of the door, and when the system is activated by a user through a first motion of compressing the push button against the force of the spring, and through a second motion of rotating of the lever handle from the horizontal orientation to the vertical orientation, the user, in a complex and compound motion, is able to allow the door to be opened.

* * * * *